US006742666B1

(12) United States Patent
Bried et al.

(10) Patent No.: US 6,742,666 B1
(45) Date of Patent: Jun. 1, 2004

(54) CONTAINER LID WITH FLIP DOOR

(75) Inventors: David K. Bried, Rockford, IL (US); George Solowiejko, Rockford, IL (US); Gary D. Johnson, Rockford, IL (US); C. Alan Peet, Waterman, IL (US); Philip M. Baerenwald, Rockton, IL (US); Michael A. Yarbro, Rockford, IL (US)

(73) Assignee: J.L. Clark, Inc., Rockford, IL (US)

( * ) Notice: Subject to any disclaimer, the term of this patent is extended or adjusted under 35 U.S.C. 154(b) by 21 days.

(21) Appl. No.: 09/886,800

(22) Filed: Jun. 21, 2001

Related U.S. Application Data

(63) Continuation-in-part of application No. 09/803,462, filed on Mar. 9, 2001.

(51) Int. Cl.[7] ..... B65D 43/26

(52) U.S. Cl. ..... 215/235; 215/295; 215/341; 215/354; 220/254.3; 220/847; 220/283; 222/556

(58) Field of Search ..... 215/235, 237, 215/301, 295, 341, 354; 220/847, 281, 283, 826, 827, 831–834, 254.1, 254.3, 254.7; 222/556, 456

(56) References Cited

U.S. PATENT DOCUMENTS

| | | | | | |
|---|---|---|---|---|---|
| 2,845,104 | A | * | 7/1958 | Frankel | 220/834 |
| 3,217,949 | A | | 11/1965 | Davis | |
| 3,323,671 | A | | 6/1967 | Minarik, Jr. et al. | |
| 3,419,198 | A | | 12/1968 | Pettersen | |
| 3,836,056 | A | | 9/1974 | Pehr | |
| 3,845,872 | A | * | 11/1974 | Towns et al. | 215/224 |
| 3,850,350 | A | * | 11/1974 | Towns et al. | 222/556 |
| 4,010,875 | A | | 3/1977 | Babiol | |
| 4,127,221 | A | | 11/1978 | Vere | |
| 4,158,902 | A | | 6/1979 | Chernack et al. | |
| 4,168,032 | A | | 9/1979 | Sneider | |
| 4,209,100 | A | | 6/1980 | Uhlig | |
| 4,220,248 | A | | 9/1980 | Wilson et al. | |
| 4,223,814 | A | * | 9/1980 | Sneider | 220/281 |
| 4,244,495 | A | | 1/1981 | Lorscheid et al. | |
| 4,261,480 | A | | 4/1981 | Fuss | |
| 4,262,802 | A | * | 4/1981 | Laauwe | 206/540 |
| 4,291,818 | A | | 9/1981 | Nozawa et al. | |
| 4,369,901 | A | | 1/1983 | Hidding | |
| 4,371,095 | A | * | 2/1983 | Montgomery et al. | 215/211 |
| 4,399,928 | A | * | 8/1983 | Klingler | 215/237 |
| 4,457,458 | A | | 7/1984 | Heinol | |
| 4,494,679 | A | | 1/1985 | Cleevely | |
| 4,504,009 | A | | 3/1985 | Boik et al. | |
| 4,558,806 | A | | 12/1985 | Shabram, Sr. et al. | |
| 4,580,687 | A | | 4/1986 | Lewis | |
| 4,607,768 | A | * | 8/1986 | Taber et al. | 215/237 |
| D292,889 | S | | 11/1987 | Ostrowsky | |
| 4,736,858 | A | * | 4/1988 | Shastal | 215/236 |
| 4,776,501 | A | | 10/1988 | Ostrowsky | |
| 4,898,292 | A | * | 2/1990 | VerWeyst et al. | 215/237 |
| 4,901,892 | A | | 2/1990 | Song | |
| 4,911,337 | A | * | 3/1990 | Rosenthal | 220/819 |

(List continued on next page.)

*Primary Examiner*—Robin A. Hylton
(74) *Attorney, Agent, or Firm*—Leydig, Voit & Mayer, Ltd.

(57) ABSTRACT

A lid for a container is provided generally comprising a main body and a door having a flip section pivotally connected to a push section, the push section pivotally connected to the main body. The main body includes a recess that defines a pivot wall. The flip section is positioned to engage the pivot wall and rotate relative to the push section in response to downward pressure on the push section. The floor of the recess includes a dispensing hole sized to dispense large items. Preferably, the dispensing hole is sized to accommodate a person's fingers while gasping an item. Additionally, the flip section of the door includes a sealing ring projecting from the underside of the door. The sealing ring is sized to engage the inner periphery of the dispensing hole to provide a seal to preserve organic or other perishable items.

34 Claims, 9 Drawing Sheets

U.S. PATENT DOCUMENTS 4,923,085 A 5/1990 Lillelund et al.
4,936,494 A 6/1990 Weidman
4,969,572 A * 11/1990 vanKerkhoven et al. .... 220/253
D314,708 S 2/1991 DeCoster
5,048,730 A * 9/1991 Forsyth et al. ..... 215/235
D321,137 S 10/1991 Hofmann et al.
D322,760 S 12/1991 Blanchette
5,082,114 A 1/1992 Bunin
5,105,986 A * 4/1992 Pham et al. ..... 222/145.8
D328,711 S 8/1992 Deflander
D329,604 S 9/1992 Kuczer
5,163,559 A 11/1992 Bunin
D331,877 S 12/1992 Robichaud et al.
5,176,277 A 1/1993 Schuermann
5,193,722 A 3/1993 Groya et al.
5,195,645 A 3/1993 Schuermann
D335,817 S 5/1993 Greubel
D339,290 S 9/1993 Close
D340,188 S 10/1993 Forsyth
5,273,177 A 12/1993 Campbell
5,285,917 A 2/1994 Hofmann
5,339,993 A 8/1994 Groya et al.
5,346,086 A 9/1994 Harris
D352,899 S 11/1994 Molo
D355,121 S 2/1995 Kohl
D355,846 S 2/1995 Denney et al.
D363,222 S 10/1995 Lay
D363,671 S 10/1995 Mueller
5,499,736 A 3/1996 Kohl
D369,942 S 5/1996 Ahern, Jr.
5,531,347 A 7/1996 Goulding
5,549,214 A 8/1996 Harris
5,579,961 A * 12/1996 Zimmerman ..... 222/545
5,611,451 A 3/1997 Mosior et al.
5,706,981 A 1/1998 Nobakht
5,718,347 A 2/1998 Walker et al.
5,730,310 A 3/1998 Yoshihara
5,782,388 A 7/1998 De Nervo
5,799,838 A 9/1998 Miller
D407,976 S 4/1999 Ekkert
5,927,535 A * 7/1999 Goth ..... 220/254.3
D426,772 S 6/2000 Kahl
6,102,257 A 8/2000 Goyet

* cited by examiner

CONTAINER LID WITH FLIP DOOR

This patent application is a continuation-in-part of U.S. patent application Ser. No. 09/803,462, filed Mar. 9, 2001.

FIELD OF THE INVENTION

The present invention relates generally to container lids, and more particularly relates to doors provided in container lids.

BACKGROUND OF THE INVENTION

Containers are used for a plethora of goods, including organic or perishable items such as food or spices. The conventional lid for a spice container contains an array of small holes for dispensing the small sized contents, typically in the form of powders or small particles, while a door is operable to cover and reveal the array of dispensing holes. It is desirable to have an easy-to-open door, and one such door commonly used with spice containers is a double-hinged door. This type of door generally comprises two different sections hinged together, one of those sections being hinged to the lid. The structure of the lid beneath the door is designed such that pressing downwardly on the door section hinged to the lid causes the other door section to flip upwardly revealing the array of dispensing holes.

While the door should be easy opening, the contents need to be properly sealed to preserve the integrity of the contents since they are organic. Thus, it is common for the underside of a door portion to include pegs which are sized and spaced to engage the array of holes and individually seal each hole. These peg and hole pairs do hinder the opening of the door to a certain degree, but are not prohibitive. More particularly, as the flip section rotates, the peg and hole pairs closest to the hinged connection of the door sections are the last to become unsealed, and hence the flip section is at a substantial angle as are its pegs. Thus, the pegs are usually bent while at least partially within the hole, requiring increased force to open and close the door.

Unfortunately, these lids are unable to dispense products that are not intended to be shaken out of the container. A person must turn the container upside down or at least sideways to dispense product, which is not suitable for all types of products. Similarly, one cannot reach into the container to remove items, whether or not they are capable of being shaken out of the container. Moreover, these containers and lids are generally in a very controlled environment, such as a shelf or cupboard, where inadvertent opening of the door is unlikely. Even so, clean up is usually not a problem. It will be recognized that there are numerous other environments in which small containers are used that are not as hospitable, and are less controlled such that inadvertent opening of the container is more likely. For example, inadvertent opening is more likely in a person's pocket or their bag where the environment is more volatile, and is not a place where spills are easily cleaned or otherwise dealt with. Therefore, there exists a need for a container lid that can dispense the contents without shaking or turning the container upside down, and which also protects from inadvertent opening in a more hostile and less controlled environment.

BRIEF SUMMARY OF THE INVENTION

In light of the above, it is a general aim of the present invention to provide a container lid having a double hinged door covering a large dispensing hole, the door being operable to reliably seal the hole and protect the contents of the container.

In that regard, it is an object of the present invention to provide such a lid having a dispensing hole that allows a person to retrieve items from the container by directly grasping or pinching the items rather than shaking them.

It is a further object of the present invention to prevent inadvertent opening the door and breaking of the seal.

In accordance with these objects, the present invention provides a lid for a container comprising a main body having a recess. The recess includes a first portion and a second portion separated by a pivot wall. A door is sized to be received within the recess, the door comprising a flip section pivotally connected to a push section, the push section pivotally connected to the main body. The flip section is positioned to engage the pivot wall and rotate towards the push section in response to downward pressure on the push section. The first portion of the recess has a dispensing hole for dispensing product, the dispensing hole preferably covering an area at least 0.9 square inches. Finally, an underside of the flip section of the door includes a sealing ring projecting downwardly, the sealing ring sized to correspond with the dispensing hole to provide a seal. This construction uniquely preserves the contents of the container while providing a larger hole suitable for other methods of retrieving the contents of the container.

According to more detailed aspects of the present embodiment, the dispensing hole more preferably covers an area at least 1.25 square inches and is sized to accommodate at least two human fingers. Most preferably, the dispensing hole covers at least 2.0 square inches. The sealing ring extends around the outer periphery of the flip section, while the dispensing hole covers a majority of the first portion of the recess.

According to another embodiment of the present invention, a container lid is provided generally comprising a main body having a recess. The recess includes a first portion and a second portion separated by a pivot wall, the first and second portions each having a floor. A door is sized to be received within the recess, the door comprising a flip section pivotally connected to a push section, the push section pivotally connected to the main body. The flip section is positioned to engage the pivot wall and rotate towards the push section in response to downward pressure on the push section. The first portion of the recess includes a dispensing hole for dispensing product, the dispensing hole covering at least 75% of the first portion of the recess. An underside of the flip section of the door has a sealing ring projecting downwardly, the sealing ring sized to correspond with the dispensing hole to provide a seal. More preferably, the dispensing hole covers at least 85% and most preferably 95% of the first recess portion.

According to more detailed aspects of the present embodiment, the main body is divided into a first body portion and a second body portion, the first body portion containing the first recess portion and the second body portion containing the second recess portion. Preferably, dispensing hole covers at least 70% of the first body portion, and more preferably covers at least 75% and most preferably at least 80% of the first body portion. In terms of the entire closure, the dispensing hole preferably covers at least 20% of the total area of the closure, more preferably 30% and most preferably 40%.

According to a further embodiment of the present invention, a lid for a container having organic goods is provided generally comprising a main body having a recess. The recess includes a first portion and a second portion separated by a pivot wall, the first and second portions each having side walls and a floor. A door is sized to be received within the recess, the door comprising a flip section pivotally connected to a push section, the push section pivotally connected to the main body. The flip section is positioned to engage the pivot wall and rotate from a closed position to an open position in response to downward pressure on the push section. The first portion of the recess has a dispensing hole for dispensing product, and an underside of the flip section of the door has a sealing ring projecting downwardly. The sealing ring is sized to correspond with the dispensing hole to provide a seal when the flip section of the door is in a closed position. Further, a detent is located in the push section to positively position the push section in its closed position and prevent inadvertent opening of the flip section. Preferably, the detent comprises a at least one tab and at least one notch, the tab formed in one of the push section and the side wall of the second recess portion, and the notch formed in the other one of the push section and the side wall of the second recess portion. Alternately the detent may comprise a pin and socket or a tongue and groove. Most preferably, the lid includes an additional notch vertically spaced from the first notch, so that the tab positioned to sequentially engage the two notches. The sealing ring of the flip section frictionally engages the main body in the closed position to securely position the flip section, while the detent securely positions the push section in the closed position.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figures 1, 2, 3:
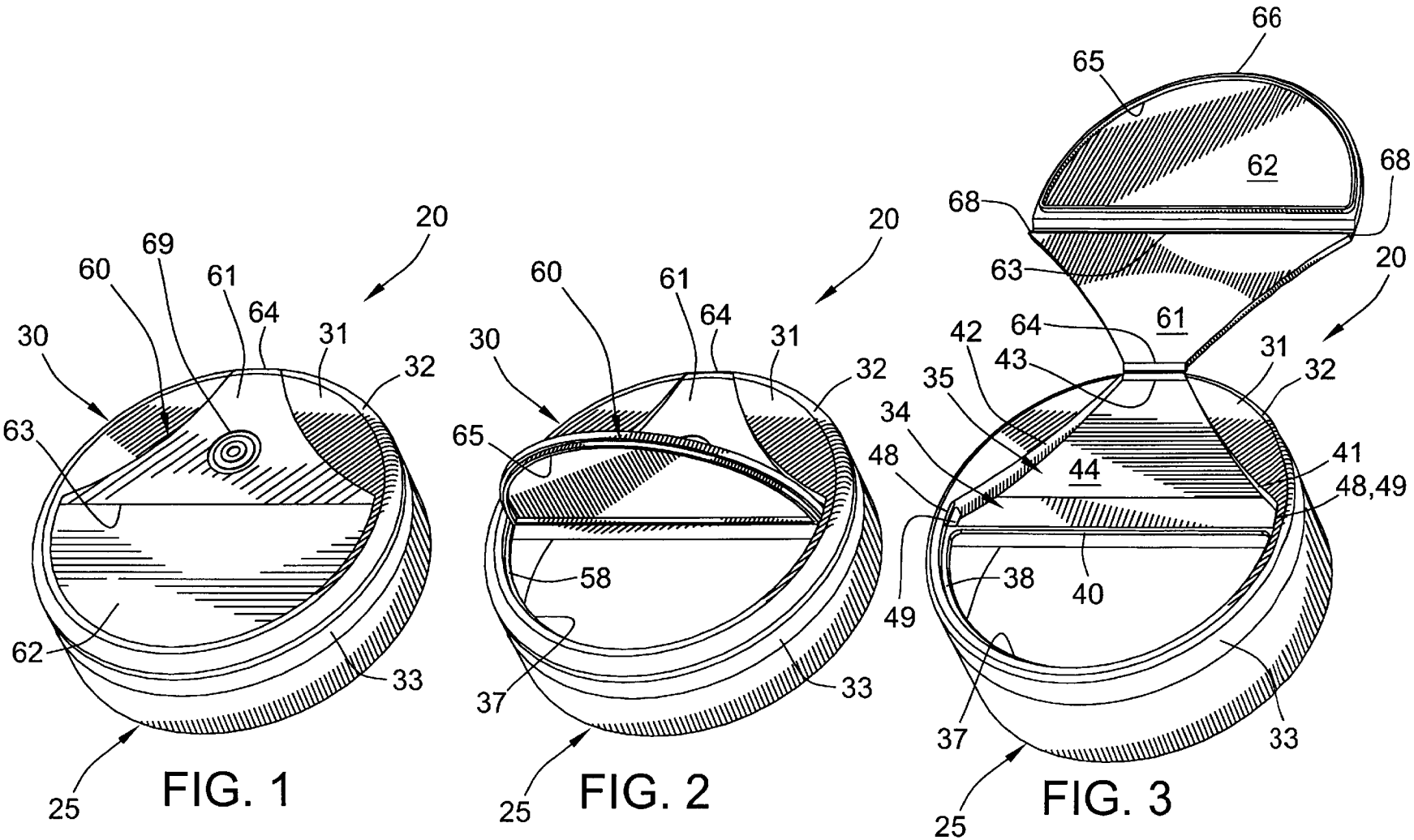
FIG. 1 is a perspective view of an embodiment of the container and lid assembly constructed in accordance with the teachings of the present invention.
FIG. 2 is a perspective view of the container and lid assembly of FIG. 1 having the door in an open state.
FIG. 3 is a perspective view of the container and lid assembly of FIG. 1 showing the lid in an as-molded condition.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Referring now to the drawings, FIGS. 1–8 illustrate one embodiment of the present invention. The general structure and operation of the present invention will be described in reference to these figures. Then, a few of the many alternate embodiments of the present invention will be described with reference to FIGS. 9–15. All of the figures depict a container and lid assembly, although the present invention is directed primarily towards the lid portion of the assembly.

Figure 4:
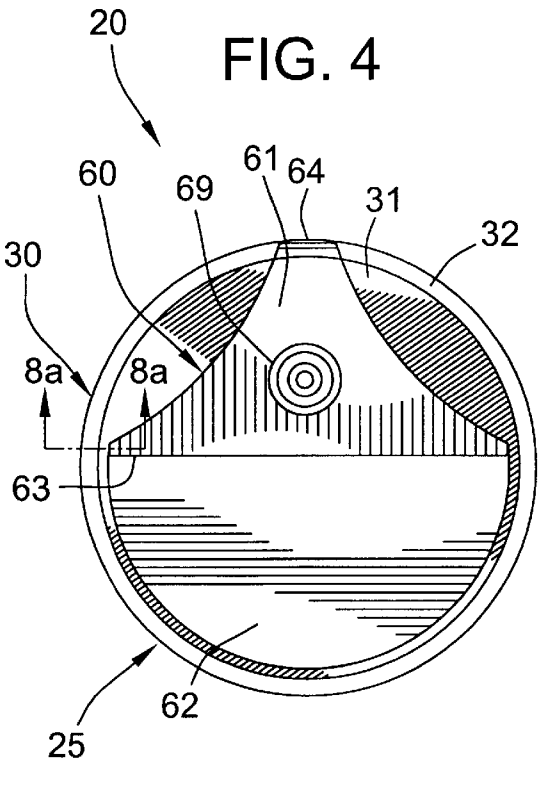
FIG. 4 is a top view of the container and lid assembly of FIG. 1.

With reference to FIGS. 1 and 4, a container and lid assembly 20 is depicted and generally comprises a cylindrical container 25 and a round and generally planar lid 30. The lid 30 of the present invention generally comprises a main body 31 and a door 60. The main body 31 includes a radiused outer peripheral edge 32 and a downwardly depending skirt 33 which engages the upper edge of the container 25. The door 60 generally comprises a push section 61 pivotally connected to a flip section 62 by a hinge 63. The hinge 63 is preferably a living hinge integrally formed with each of the push and flip sections 61, 62. The push section 61 is pivotally connected to the main body 31 via another living hinge 64 integrally formed with the outer peripheral edge 32. Hinge 64 is also a living hinge and comprises a thin strip of flexible material and maintains the radius of the outer peripheral edge 32, i.e., the hinge 64 is generally flush with the outer peripheral edge 32, both vertically and horizontally. It will also be recognized that the hinge 64 may also project, typically horizontally, from the outer periphery of the edge 32 and container 25, as is known in the art.

Figure 5:
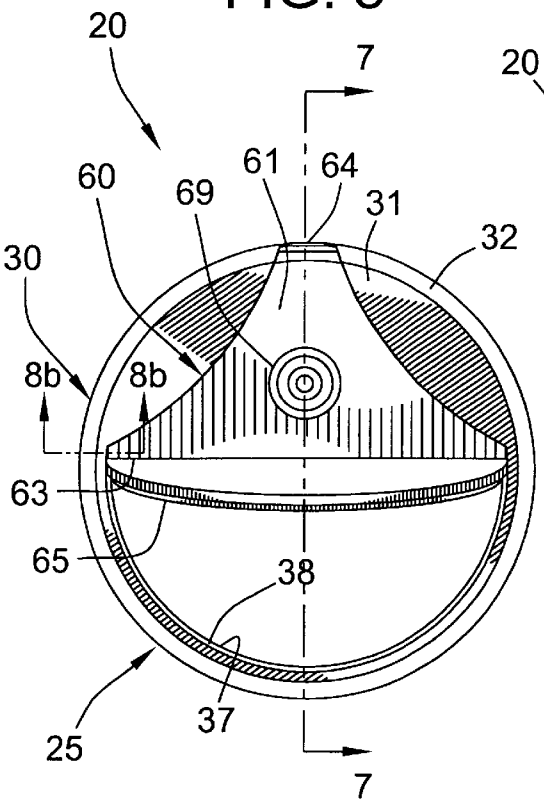
FIG. 5 is a top view if the container and lid assembly of FIG. 2.

As illustrated in FIGS. 2, 5 and FIGS. 3, 6, the double hinged lid 30 is structured such that the door 60 is easily and positively actuated. FIGS. 2 and 5 illustrate the door 60 in an open position. In response to downward pressure or force on the push section 61, the flip section 62 rotates upwardly and towards the push section 61 about hinge 63. Stated another way, the flip section 62 has rotated away from the main body 31. Preferably, the push section 61 includes an indication of where to press on the lid 30 and its door 60, such as the bullseye 69 shown in the figures. In the closed position depicted in FIGS. 1 and 4, the push section 61 and flip section 62 were generally parallel to one another. In the state depicted in FIGS. 2 and 5, the lid has rotated to an open position, that position preferably being less than or equal to 90 degrees rotated relative to the main body 31. Most preferably, the flip section 62 rotates in the range of 45 to 90 degrees from the main body in the open position. The position of hinge 63 relative to pivot wall 40, as well as the depth of the recess 34 (best seen in FIGS. 3 and 6 and further described below) are controlled to regulate the rotation of the flip section 62 as described above.

Figure 6:
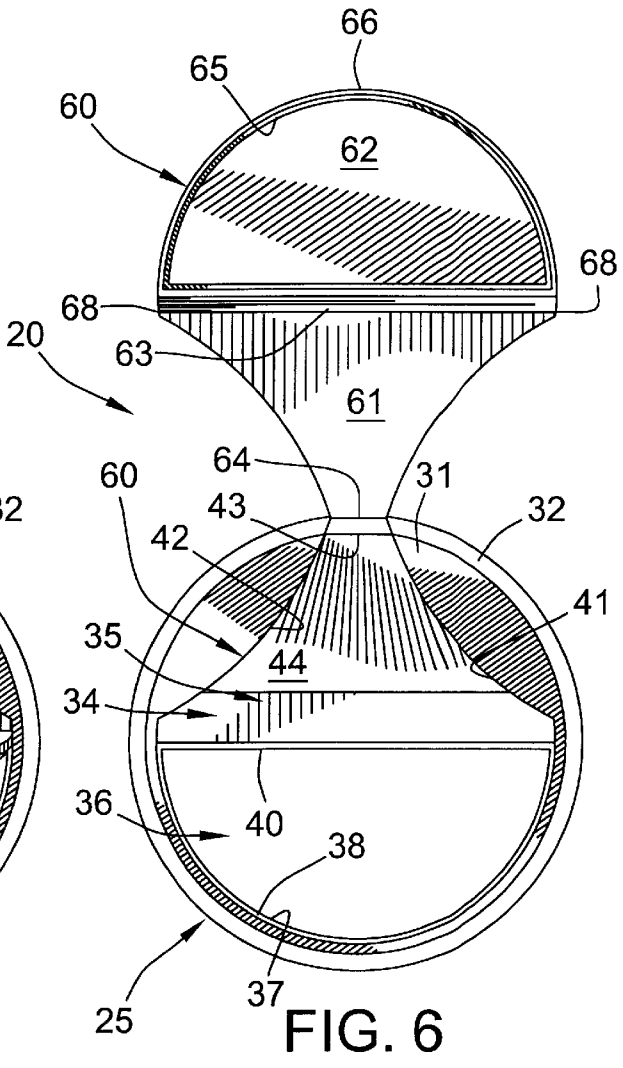
FIG. 6 is a top view of the container and lid assembly of FIG. 3.

FIGS. 3 and 6 depict the lid 30 having its door 60 in an as-molded state. In this condition, the push section 61 has rotated relative to the main body about hinge 64. The main body 31 includes a recess 34 generally comprising a first portion 35 and a second portion 36. The first portion 35 is sized to receive the push portion 61 of the door 60. The first portion 35 of the recess 34 is defined by a pivot wall 40 and a rear wall 43 connecting a pair of opposing side walls 41, 42. The push section 61 is hingedly connected to the main body 30 adjacent the rear wall 33. The flip section 62 includes a nub 66 that allows the flip portion 62 of the door 60 to frictionally and securely engage the main body 31 of the lid 30 in the closed position. The main body 31 may include a corresponding groove (not shown) to receive and engage the nub 66.

The second portion 36 of the recess 34 is sized to correspond with the flip section 62 of the door 60. In the floor of the second portion 36 of the recess 34, there is defined a large dispensing hole 37 for gaining access to the contents of the container. In fact, the hole is large enough to accommodate at least two fingers of a person retrieving contents of the container. Thus the hole is preferably sized to have an area of at least 0.9 $in^2$, more preferably at least 1.25 $in^2$, and most preferably at least 2.0 $in^2$. The second portion 36 of the recess 34 and the dispensing hole 37 define a ledge 38 for supporting the outer periphery of the flip section 62. Additionally, the flip section 62 preferably contains a sealing ring 65 projecting downwardly from an underside of the flip section 62. The sealing ring 65 has a smooth unbarbed periphery which is sized to correspond with the dispensing hole 37 and frictionally engages the inner periphery of the hole 37 to effectively seal the contents of the container 25. Therefore, the lid 20 not only allows a person to grasp product in the container with their fingers, but also effectively seals the dispensing hole 37 to protect products such as organics or perishable items.

Figure 7:
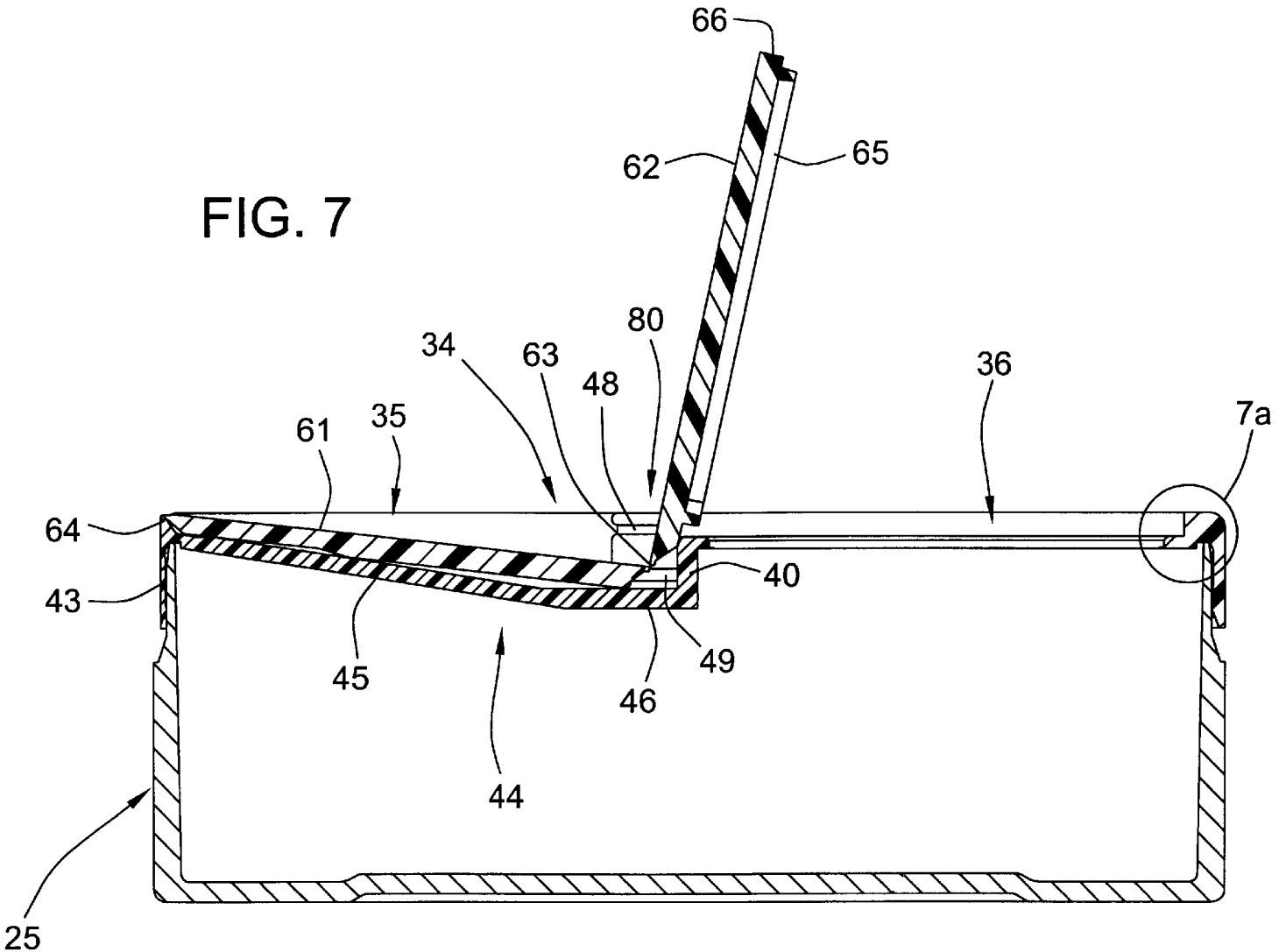
FIG. 7 shows a cross-sectional view of the container and lid assembly taken about the line 7—7 of FIG. 5.
Figure 7A:
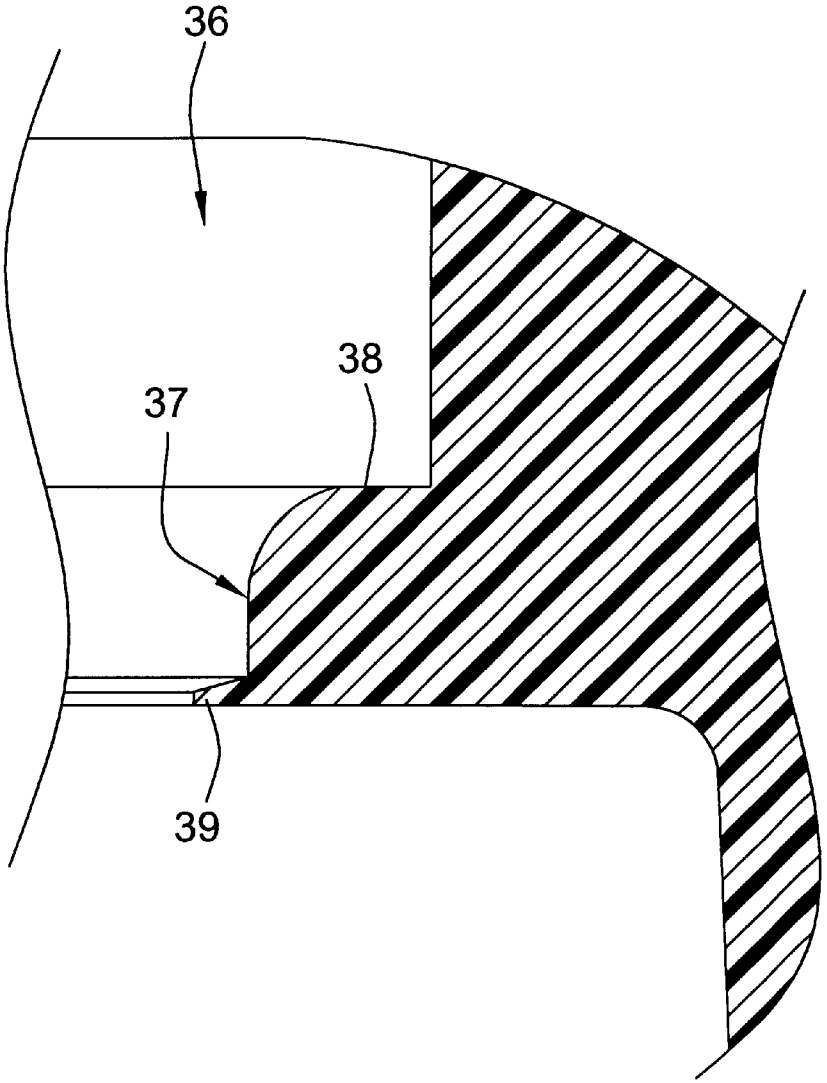
FIG. 7*a* is an enlarged view of a portion of FIG. 7 denoted by circle 7*a*.

As best seen in FIGS. 7 and 7*a*, the inner periphery of the dispensing holes 37 preferably includes a seal flange 39 which extends around the entire periphery of the hole. The seal flange 39 is located at a downward edge of the inner periphery of the dispensing hole 37. The seal flange 39 is used to provide an extremely reliable and effective hermetic seal to protect the contents of the container. The seal flange 39 is small enough (about 0.01 inches wide and tapering from 0.002 inches to 0.005 inches tall) and is of a material such as plastic which will deflect. More specifically, the flange 39 is resiliently deflectable so that when the door 60 is placed in its closed position, specifically the flip section 62 of the door, the sealing ring 65 which is sized to correspond with the dispensing hole 37 will engage the top tapered surface of the seal flange 39 and force it to deflect it generally downwardly against the sealing ring 65. Accordingly, the sealing ring 65 engages not only the inner periphery of the dispensing hole 37, but also the sealing flange 39 which will deflect slightly to ensure a secure engagement, thereby providing a reliable hermetic seal.

The seal ring 65, preferably including the seal flange 39, also operate to protect the door 60 from inadvertent opening. It will be recognized by those skilled in the art that when the door 60 is closed and a seal is formed by the seal ring 65, that seal also frictionally restricts the opening of the door 60, and more specifically the flip section 62 of the door. Additionally, the detent mechanism 80 controls the opening of the push section 61, and hence restricts the opening of the flip portion 62 and inadvertent opening of the door 60 generally. As previously noted, the flip portion 62 also includes a nub 66 (FIG. 3) that is structured so that the flip portion 62 of the door 60 frictionally and securely engages the main body 31 in the closed position. All of these features, either alone or in some combination, operate to provide means for keeping the door 60 in its closed position.

At the same time, the lid 20, and particularly its dispensing hole 37, is structured and oriented to maximize the size of the hole. The recess 34 includes first and second portions 35, 36 and also includes a floor 44. The floor in the area of the second portion 36 has been largely removed to define the dispensing hole 37. In fact, a very small strip of material is left to define the ledge 38 for supporting the outer periphery of the flip section 62. Preferably, the dispensing hole 37 covers at least 75% of the second portion 36 of the recess 34. More preferably the dispensing hole covers 85%, and most preferably 95% of the second recess portion. In the embodiment illustrated, the radius of the curved portion of the dispensing hole 37 is 1.17 inches, while the radius of the curved portion of the second recess portion 36 is about 1.2 inches. The radius of the outer edge of the lid is about 1.35 inches. Thus, in the illustrated embodiment, the dispensing hole 37 covers about 95% of the area corresponding to the second recess portion 36. It can therefore be seen that the lid 20 provides a large, maximized opening while also reliably protecting the door 60 from inadvertent opening and breaking of the seal.

The provision of a large dispensing hole 37 and the ability to reliably seal and keep the door closed can also be thought of in terms of maximizing the use of the lid 20. For example, the dispensing hole preferably covers at least 70% of the second body portion, more preferably at least 75% and most preferably 80% of the second body portion. In terms of the entire closure, the dispensing hole covers at least 20% of the total are of the closure, more preferably 30% and most preferably 40%.

The amount of space available within the container for the contents has also been maximized. It can be seen in FIGS. 7 and 8*d* that the floor 44 of the recess 34 is sloped. Preferably, a first portion of the floor 45, representing a majority of the floor, is angled to slope downwardly and inwardly from a position adjacent the rear wall 43 and the hinge 64. The remaining portion of the floor 46 is generally flat or horizontal. Preferably, a substantial portion of the floor of the recess is angled downwardly and inwardly. The angled portion 45 of the floor 44 serves several purposes. First, the structure eliminates unused space to create increased holding capacity in the container 25. The angled floor portion 45 also limits the flexure of the push section 61, thereby increasing its life under repeated stresses. It can be seen in FIG. 7 that the push section 61 is disposed proximate the angled portion 45 of the floor 44 when in the open position, corresponding to a first open position of the flip section 62. Since the angles of the push section 61 and angled floor portion 45 are somewhat similar, the angled floor portion 45 being angled relative main body 31 slightly more than the push section 61 is angled, the amount of flexure in the push portion 61 is very limited.

With reference to FIGS. 6, 7 and 8*a*–8*d*, the positive acting and controlled opening of the door 30 will be described in more detail. The lid 30 contains a detent mechanism 80 to control the opening of the door 60. The location of the hinge 63 connecting the push section 61 and flip section 62 is selected such that downward pressure on the push section 61 causes the flip section 62 to engage the pivot wall 40. As the push section 61 rotated downwardly into the first recessed portion 35, the flip section 62 rotates upwardly, away from the main body 31 and towards the push section 61. The detent mechanism 80 controls this opening, and in the preferred embodiment comprises a pair of notches 48, 49 (FIGS. 7 and 8*a*) formed in each opposing side wall 41, 42 of the recess 34, and more particularly the first portion 35 of the recess 34. The push section 61 of the door 60 includes a tab 68 (FIGS. 6 and 8*a*) on each opposing side positioned to correspond with the pair of notches 48, 49. Each tab 68 is positioned to sequentially engage the two notches 48, 49 in the respective side wall 41, 42. The detent mechanism may also be reversed with the notches on the door and the tabs on the side walls.

Figure 8A:
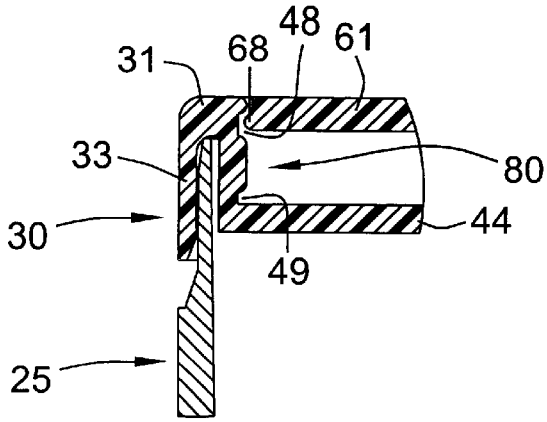
FIG. 8*a* is a cross-sectional view of the container and lid assembly taken about the line 8*a*—8*a* of FIG. 4.
Figure 8B:
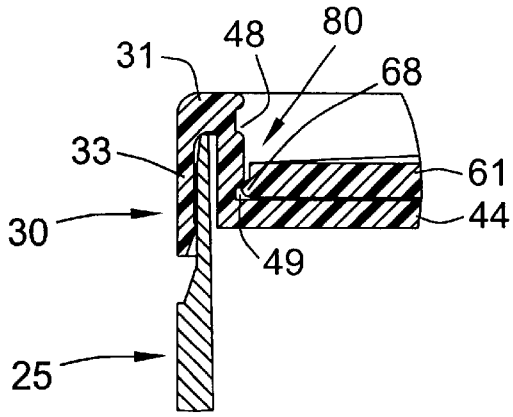
FIG. 8*b* is a cross-sectional view of a container and lid assembly taken about the line 8*b*—8*b* of FIG. 5.

The detent mechanism 80 controls the opening of the door 60 in at least two stages, as represented in FIGS. 8*a* and 8*b*. In the first stage, the detent mechanism 80 substantially fixes the push section 61 in a closed position. In the second stage, the detent mechanism substantially fixes the push section in an open position. More specifically, in the closed position (depicted in FIGS. 1 and 4) the tabs 68 of the push section 61 engage the upper notch 48 as shown in FIG. 8*a*, thereby positioning the flip section 62 in a position generally parallel with the push section 61 and the main body 31. The detent mechanism 80 thus prevents inadvertent opening of the door 60. In response to downward pressure on the push section 61, the tabs 68 disengage the upper notches 48 and move downwardly until the are positively positioned within the lower notches 49 as shown in FIG. 8*b*. In this open position of the push section 61, the flip section 62 has engaged the pivot wall 41 and rotated towards the push section 61 to its open position. With the flip section 62 in the open position, access to the container 25 is possible through the dispensing hole 37, and the door 60 may be completely moved by merely grasping either section of the door and causing the push section 61 to rotate relative to the main body 31 about its hinge 64. The push section 61 is thus selectively operable between at least two locked positions corresponding to open and closed positions of the flip section 62 (FIGS. 1 and 4, and FIGS. 2 and 5).

Figure 8C:
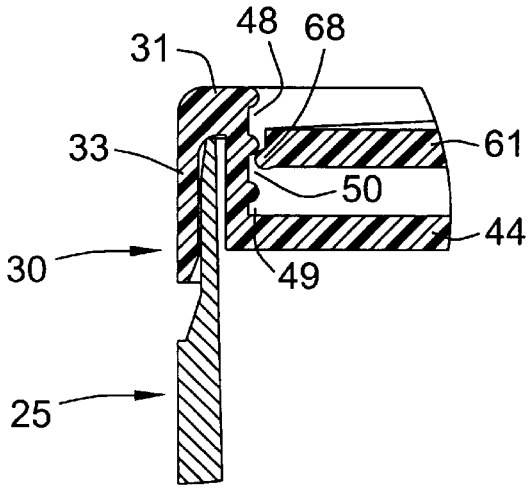
FIG. 8*c* is a cross-sectional view of a container and lid assembly similar to 8*a* and 8*b* depicting an alternate embodiment of the detent mechanism.
Figure 8D:
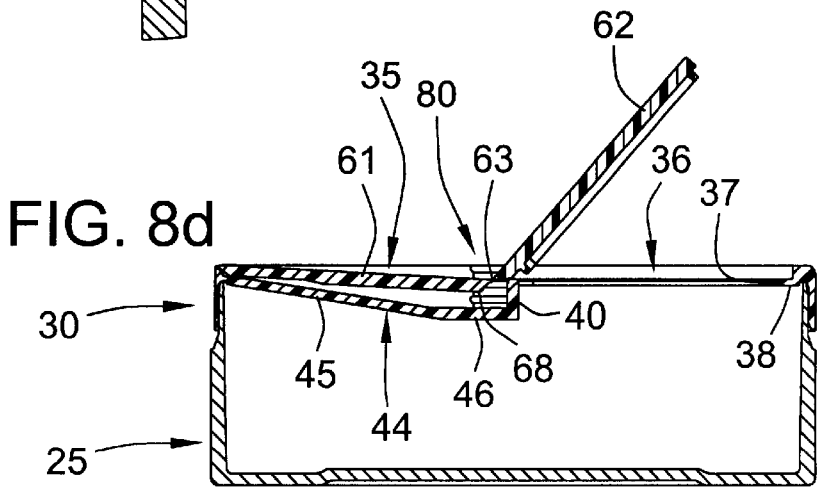

With reference to FIGS. 8*c* and 8*d*, the detent mechanism 80 may further comprise additional notches corresponding to additional stages or stages of open positions of the door 60. In FIGS. 8*c* and 8*d*, a third notch 50 is positioned adjacent the first and second notches 48, 49, all of which are vertically spaced. In this embodiment, the door 60 starts in a closed position (FIG. 8*a*) wherein the push section 61 is generally horizontal having its tabs 68 engaging the upper notch 48. Upon a downward pressure, the push section 61 disengages the upper notch 48 and then rotates downwardly to engage the middle notch 50. In this position, namely a partially open position (FIG. 8*c*), the flip section 62 has rotated a much smaller amount than as depicted in FIG. 7, due to the additional detent. Preferably, the partially open position corresponds with an angle of 0 to 45 degrees, as is shown in FIG. 8*d*. Upon further pressure on the push section 61, the tabs 68 disengage the middle notch 50 and move to the lower notch 49. This stage corresponds to a fully open position (FIGS. 2 and 5), wherein the flip section 62 has rotated more than in the partially open position, as can be seen from the open position shown in FIG. 7. In this fully open position, the flip section 62 has preferably rotated relative to the main body 31 about 45 to 90 degrees, most preferably less than 90 degrees.

It will be recognized by those skilled in the art that any number of detents, i.e. notches, can be utilized to stage or otherwise effectively control the opening of the double hinged door 60. It will also be recognized that the multiple staged opening as depicted in the embodiment of FIGS. 8*c* and 8*d*, can be effectuated with only two notches. To accomplish this, the position of the upper notch 48 must be closely regulated. The flip section 62 of the door frictionally engages the main body 31, typically via the nub 66 and/or the sealing ring 65. The amount of downward pressure on the push section 61 to disengage the tabs 68 from the upper notches 48 can be regulated such that the downward pressure causes the flip section 62 to disengage from its frictional engagement with the main body 31 prior to the tabs 68 disengaging the upper notches 48. In this way, the flip section 62 may be rotated upward slightly, generally corresponding with the closed or partially open position (i.e. 0 to 45 degrees). Furthermore, this allows the entire door 60 to be placed in the as-molded position (as depicted in FIGS. 3 and 6) without causing the tabs 68 to disengage the upper notch 48 and move downwardly to engage the lower notch 49, before the entire door 60 may be placed in the as-molded position. However, in the preferred embodiment, the notches 48, 49 are positioned such that the push section 61 rotates due to the tabs 68 disengaging the upper notch 48 at about the same time the flip section 62 disengages the main body 31 and rotates upwardly towards the push section 61.

Figure 9A:
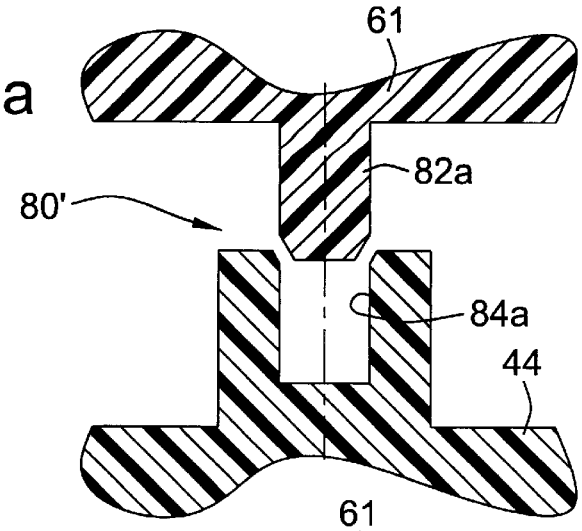
FIGS. 9*a*, 9*b* 9*c*, 9*d* and 9*e* are cross-sectional views, partially cut away, of alternate embodiments of detent mechanisms constructed in accordance with the teachings of the present invention.
Figure 9B:
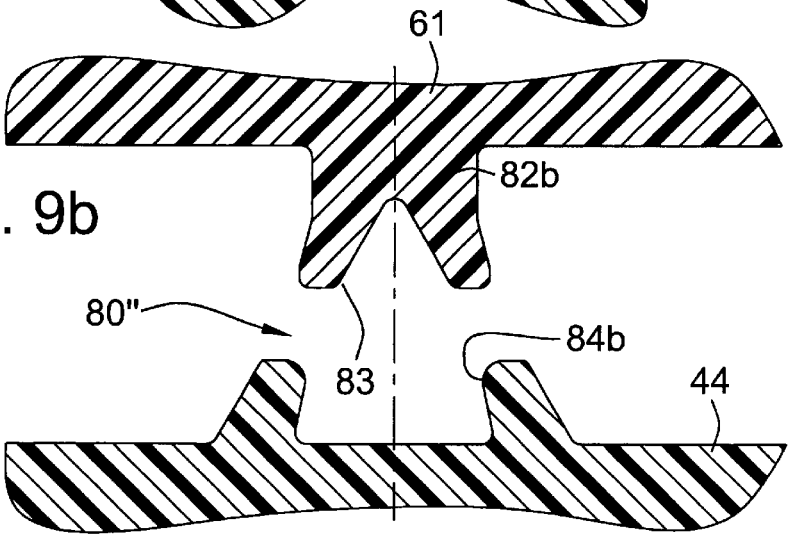
Figure 9C:
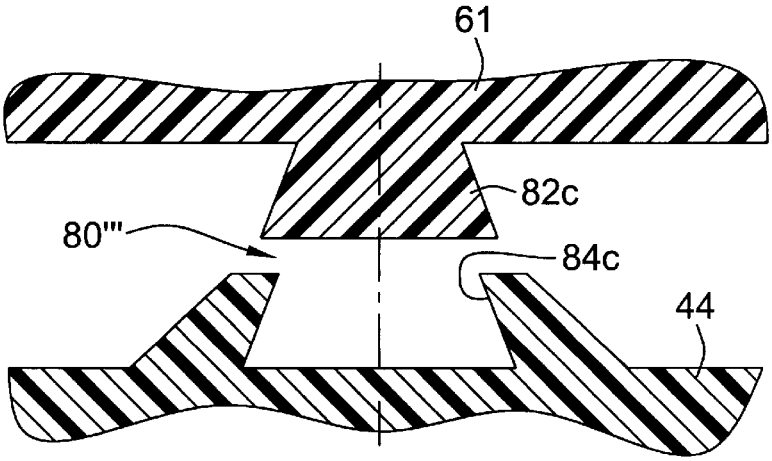

It will also be recognized by those skilled in the art that various other detent mechanisms may be utilized. As used in the specification, a detent or detent mechanism represents any structure that restricts or locks the movement of one part of a mechanism. FIGS. 9*a*, 9*b* and 9*c* illustrate alternate embodiments of the detent mechanism 80 which may be utilized in accordance with the teachings of the present invention. It will first be recognized that while the detent mechanism 80 is shown in the embodiment depicted in FIGS. 1–8 is formed into the side walls 41, 42 of the recess 34, a similar mechanism may be easily formed in the pivot wall 40 and an edge of the push section 61 of the door adjacent the hinge 63. Preferably, the detent mechanism 80 is located adjacent pivot wall 40 or away from hinge 64, to control the push section 61 where most of the section's movement occurs, thus providing the most control. It will also be recognized that the underside of the push section 61 may include a pin and socket, or tongue and groove, type of detent mechanism to effectuate the same controlled and staged opening of the door 60. Such alternate detent mechanisms are shown in FIGS. 9*a*–*c*, all of which are located on the underside of push section 61, preferably at a position directly below the bullseye 69 where downward pressure is placed for opening the door 60.

Figure 9D:
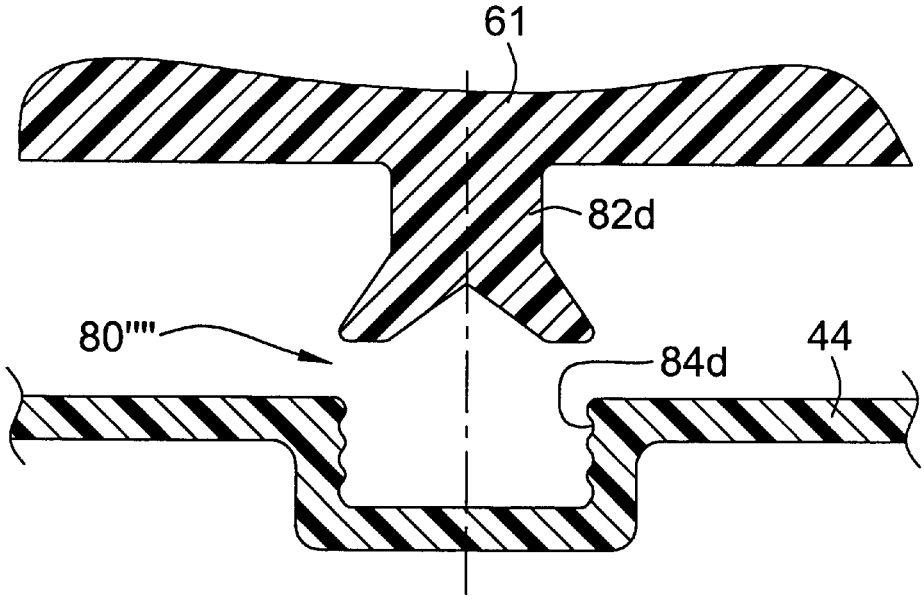
Figure 9E:
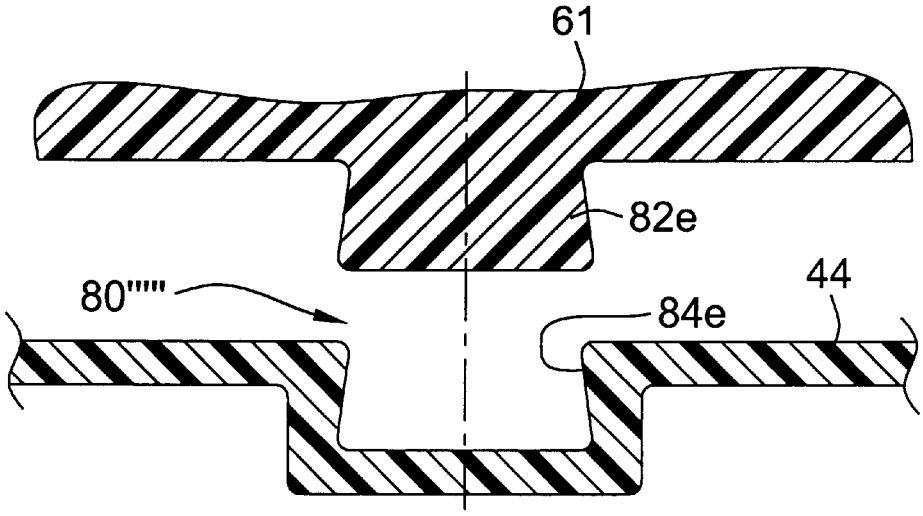

FIGS. 9*a*–*e* illustrate cross-sectional, partially cut-away, views of such detent mechanisms. As shown in FIG. 9*a*, the push section 61 of the door 60 may include a pin 82*a* which depends downwardly from the door 60. The floor 44 includes a female socket 84*a* sized to receive the pin 82*a*, forming the detent mechanism 80'. The pin 82*a* and socket 84*a* provide an interference fit when the push section is rotated downwardly. FIG. 9*b* illustrates an alternate embodiment of a pin and socket design for a detent mechanism 80". In this situation, the pin 82*b* is generally flared and includes a recessed portion 83. The recess portion 83 permits the edges of the pin 82*b* to deflect inwardly to be received within the socket 84*b*, which includes a sloped hole corresponding with the shape of the pin 82*b*. Another embodiment depicted in FIG. 9*c* includes a tongue and groove type detent mechanism 80'" which includes a deflectable tongue 82*c* sloping outwardly as it projects downwardly from the underside of the push section 61. A correspondingly shaped groove 84*c* is provided in the floor 44 of the recess. Preferably, the tongue 82*c* and groove 84*c* run generally parallel with the pivot wall 40 and hinge 63. FIGS. 9*d* and 9*e* illustrate further embodiments with alternate detent mechanisms 80"", 80"" having differently configured tongues 82*d*, 82*e* and grooves 84*d*, 84*e*. Groove 84*d* includes several detent notches 48', 49', 50' which can receive and hold tab 68' for staged opening.

While the embodiments depicted in FIGS. 9*a*, 9*b*, 9*c*, 9*d* and 9*e* only include description of detent mechanisms 80', 80", 80'", 80"", 80"" which lock the position of the push section 61 in a downward or open position of the push section 61 corresponding with an open position of the flip section 62, it will be readily recognized by those skilled in the art that such detent mechanisms can be adapted to provide a staged opening as was described with reference to FIGS. 1–8. For example, the inner walls of the sockets 84*a* and 84*b*, and groove 84*c* may include vertically spaced notches for sequential engagement by tabs on the pins 82*a* and 82*b* and tongue 82*c*. As previously stated, other known detent mechanisms can be employed in conjunction with the present invention.

Figures 10, 11, 12:
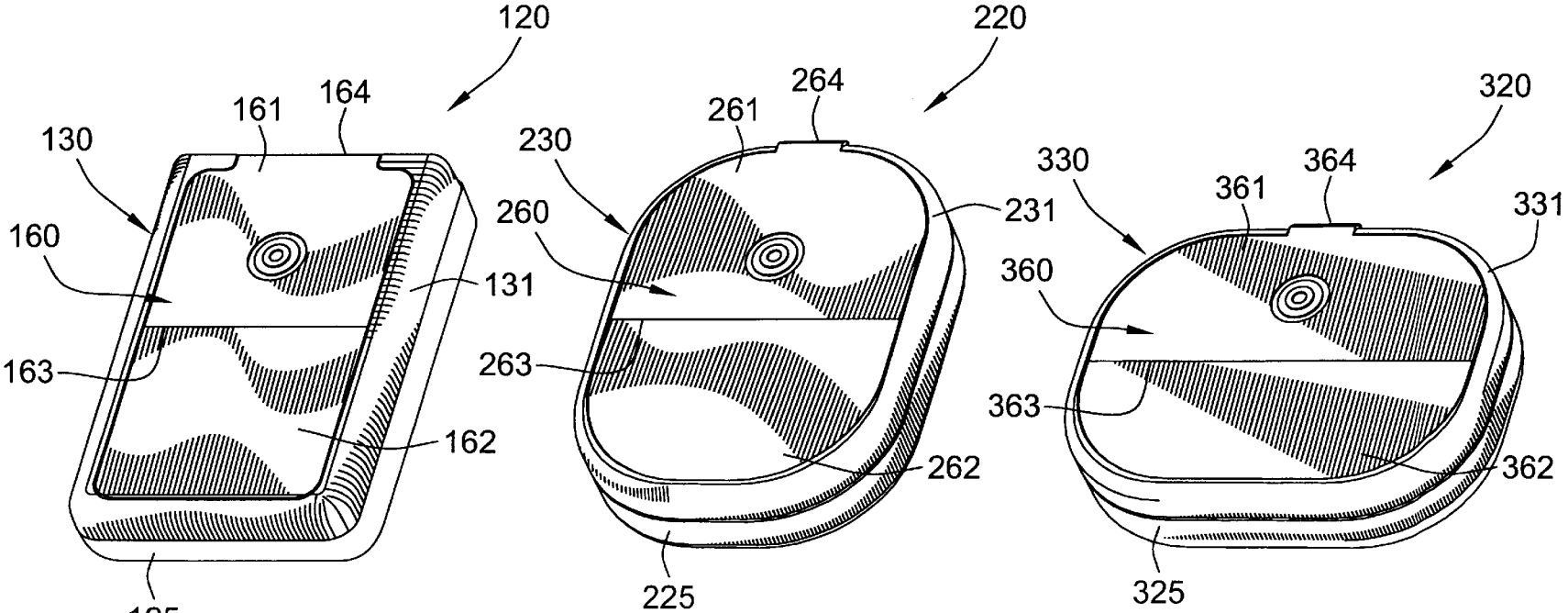
FIG. 10 shows a perspective view of another embodiment of a container and lid assembly constructed in accordance with the teachings of the present invention.
FIG. 11 shows a perspective view of another embodiment of a container and lid assembly constructed in accordance with the teachings of the present invention.
FIG. 12 shows a perspective view of another embodiment of a container and lid assembly constructed in accordance with the teachings of the present invention.
Figure 15:
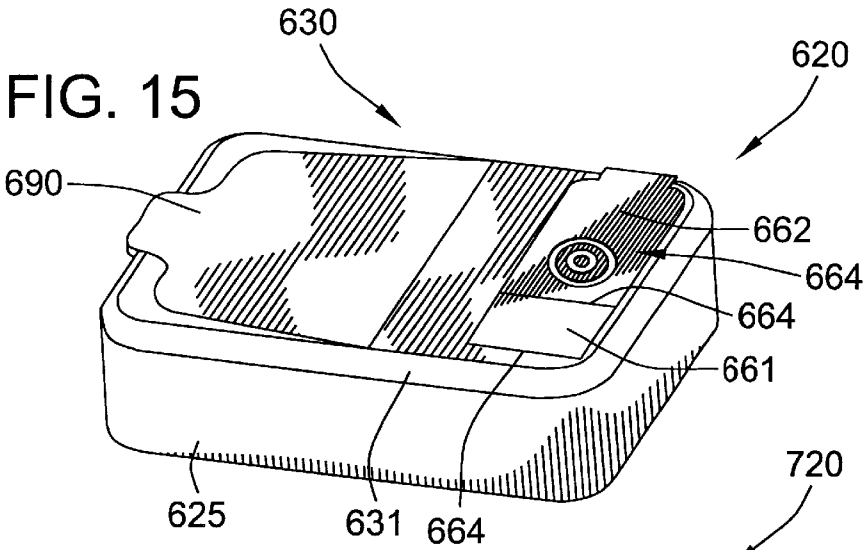
FIG. 15 shows a perspective view of another embodiment of a container and lid assembly constructed in accordance with the teachings of the present invention.
Figure 16:
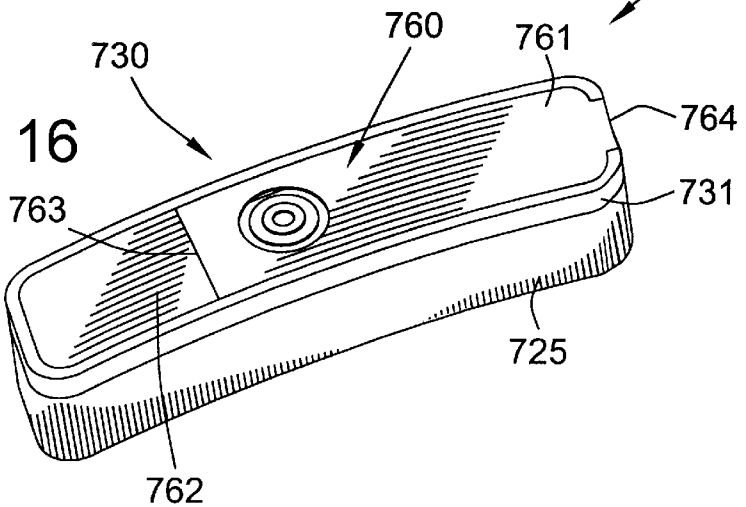
FIG. 16 shows a perspective view of another embodiment of a container and lid assembly constructed in accordance with the teachings of the present invention.
Figure 13:
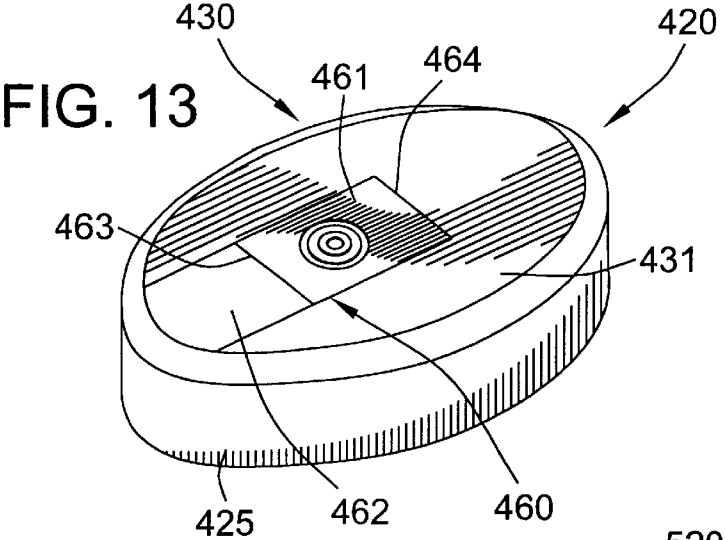
FIG. 13 shows a perspective view of another embodiment of a container and lid assembly constructed in accordance with the teachings of the present invention.
Figure 14:
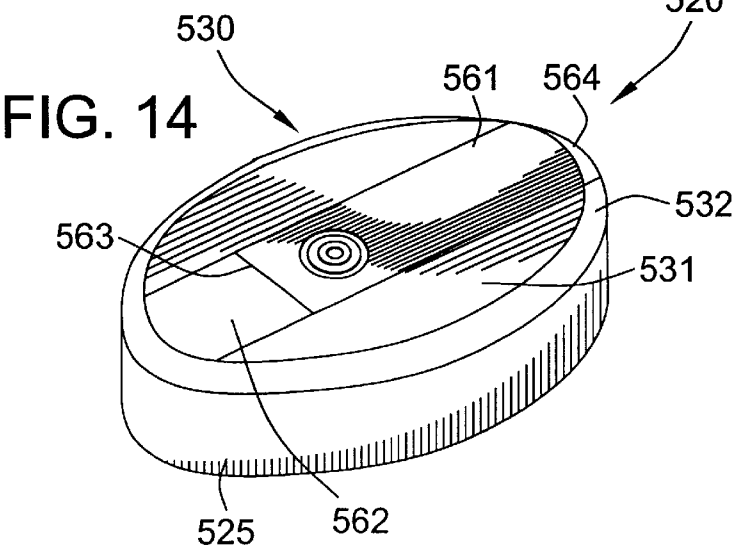
FIG. 14 shows a perspective view of another embodiment of a container and lid assembly constructed in accordance with the teachings of the present invention.

FIGS. 10–16 illustrate various other embodiments of container and lid assemblies employing the lid of the present invention. Common reference numerals will be used, although they will increase by 100's for each figure. FIG. 10 illustrates a generally rectangular container 125 having a corresponding lid 130. The lid 130 is constructed in accordance with the teachings of the present invention and includes a double hinged door 160 comprising a push section 161 and a flip section 162. The outer surface of the push section 161 includes a bullseye or other indication where to press to open. The push section 161 is pivotally connected to the flip section 162 by hinge 163 and pivotally connected to the main body 131 via a hinge 164. FIG. 11 is also generally rectangular although the corners are somewhat rounded. FIG. 11 depicts the door 260 longwise, generally similar to FIG. 10. FIG. 12 is substantially similar to FIG. 11 in overall shape, although the door 360 is generally shortwise, i.e. the width of the door 360 corresponds to a length of the container 325. FIG. 13 illustrates a circular container and lid assembly 420 having thin rectangular door 460, wherein the push section 461 is hinged to a mid portion of the main body 431 of the lid 430. Similarly, FIG. 14 illustrates an embodiment like that of FIG. 13 having a thin door 560, however the push section 561 of the door 560 is elongated and is pivotally connected to the main body 531 adjacent the outer periphery 532 of the main body 531. The door of the present invention may also be employed in conjunction with other doors, such as depicted in the lid 630 of FIG. 15. A thin double hinged door 660 is positioned shortwise along an end of the lid 630, while the other end of the lid 630 includes an additional door 690 that is independently operable. Finally, FIG. 16 illustrates a lid 730 which is generally curved or arcuate, the door 760 also being curved and covering a substantial portion of the lid 730. The lid of FIG. 16 is ideal for flask type container 725.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A lid for a container comprising:

a main body having a first portion and a second portion separated by a pivot wall;

a door sized to cover the first and second portions, the door comprising a flip section pivotally connected to a push section, the push section pivotally connected to the main body with no hinge pins, the flip section engaging the pivot wall to progressively pivot thereabout from a closed position to an open position in response to downward pressure on the push section;

the first portion of the main body having a dispensing hole for dispensing product, the dispensing hole covering at least 0.9 square inches; and an underside of the flip section of the door having a sealing ring projecting downwardly, the sealing ring having a smooth unbarbed outer periphery and sized to correspond with and frictionally engage the dispensing hole when the flip section is in the closed position to provide a seal.

2. The lid of claim 1, wherein the dispensing hole covers at least 1.25 square inches.

3. The lid of claim 1, wherein the dispensing hole covers at least 2.0 square inches.

4. The lid of claim 1, wherein the dispensing hole is sized to accommodate at least two human fingers.

5. The lid of claim 1, wherein the sealing ring extends around an outer periphery of the flip section.

6. The lid of claim 1, wherein the dispensing hole covers a majority of the first portion of the main body.

7. The lid of claim 1, wherein the dispensing hole covers substantially all of the first portion of the main body.

8. The lid of claim 1, wherein an inner periphery of the dispensing hole includes a deflectable seal flange positioned to engage the sealing ring and form part of the seal.

9. A lid for a container comprising:

a main body having a recess;

the recess having a first portion and a second portion separated by a pivot wall, the first and second portions each having a floor;

a door sized to be received within the recess, the door comprising a flip section pivotally connected to a push section, the push section pivotally connected to the main body, the flip section engaging and being supported on the pivot wall such that downward on the push section draws the underside of the flip section across the pivot wall to cause the pivot section to from a closed position to an open position;

the floor of the first recess portion having a dispensing hole for dispensing product, the dispensing hole covering at least 75% of the floor of the first recess portion; and an underside of the flip section of the door having a sealing ring projecting downwardly, the sealing ring having a smooth unbarbed outer periphery and sized to correspond with and frictionally engage the dispensing hole when the flip section is in the closed position to provide a seal.

10. The lid of claim 9, wherein the dispensing hole covers at least 85% of the first recess portion.

11. The lid of claim 9, wherein the dispensing hole covers at least 95% of the first recess portion.

12. The lid of claim 9, wherein the main body is divided into a first body portion and a second body portion, the first body portion containing the first recess portion and the second body portion containing the second recess portion, the dispensing hole covering at least 70% of the first body portion.

13. The lid of claim 12, wherein the first recess portion covers at least 75% of the first body portion.

14. The lid of claim 12, wherein the first recess portion covers at least 80% of the main body.

15. The lid of claim 12, wherein the dispensing hole covers at least 20% of the main body.

16. The lid of claim 12, wherein the dispensing hole covers at least 30% of the main body.

17. The lid of claim 12, wherein the dispensing hole covers at least 40% of the main body.

18. The lid of claim 9, wherein the inner periphery of the dispensing hole includes a deflectable seal flange positioned to engage the sealing ring and form part of the seal.

19. A lid for a container having organic goods comprising:

a main body having a recess;

the recess having a first portion and a second portion separated by a pivot wall, the first and second portions each having side walls and a floor;

a door sized to be received within the recess, the door comprising a flip section pivotally connected to a push section, the push section pivotally connected to the main body with no hinge pins, the flip section being positioned to engage and pivot about the pivot wall from a closed position to an open position in response to downward pressure on the push section;

the first portion of the recess having a dispensing hole for dispensing product;

an underside of the flip section of the door having a sealing ring projecting downwardly, the sealing ring having a smooth unbarbed outer periphery and sized to correspond with and frictionally engage the dispensing hole to provide a seal and restrict the opening of the door when the flip section of the door is in a closed position; and a detent in the door to positively position the push section in its closed position and prevent inadvertent opening of the flip section.

20. The lid of claim 19, wherein the detent comprises a tab and a notch, the tab formed in one of the push section and the side wall of the second recess portion, and the notch formed in the other one of the push section and the side wall of the second recess portion.

21. The lid of claim 19, wherein the detent comprises a pin and socket, the pin formed in one of the push section and the second recess portion, and the socket formed in the other one of the push section and the second recess portion.

22. The lid of claim 19, wherein the detent comprises a tongue and groove, the tongue formed in one of the push section and the second recess portion, and the groove formed in the other one of the push section and the second recess portion.

23. A lid for a container having organic goods comprising:

a main body having a recess;

the recess having a first portion and a second portion separated by a pivot wall, the first and second portions each having side walls and a floor;

a door sized to be received within the recess, the door comprising a flip section pivotally connected to a push section, the push section pivotally connected to the main body, the flip section being positioned to engage the pivot wall and rotate from a closed position to an open position in response to downward pressure on the push section;

the first portion of the recess having a dispensing hole for dispensing products;

an underside of the flip section of the door having a sealing ring projecting downwardly, the sealing ring sized to correspond with the dispensing hole to provide a seal when the flip section of the door is in a closed position;

a detent in the push section to positively position the push section in its closed position and prevent inadvertent opening of the flip section;

the detent comprising a tab and a notch, the tab formed in one of the push section and the side wall of the second recess portion, and the notch formed in the other one of the push section and the side wall of the second recess portion; and an additional notch vertically spaced from the first notch and positioned to provide an open detented position for the flip section, the tab positioned to sequentially engage the two notches.

24. The lid of claim 23, wherein the door is operable between an open position and a closed position, the tab engaging the upper notch in the closed position and engaging the lower notch in the open position.

25. The lid of claim 19, wherein the push section is selectively operable between at least two locked positions corresponding to open and closed positions of the flip section.

26. The lid of claim 19, wherein the inner periphery of the dispensing hole includes a deflectable seal flange positioned to engage the sealing ring and form part of the hermetic seal.

27. A lid for a container comprising:

a main body having a first portion and a second portion separated by a pivot wall, the first and second portions each having a floor;

a door sized to cover the first and second portions, the door comprising a flip section pivotally connected to a push section, the push section pivotally connected to the main body, the flip section engaging and being supported on the pivot wall such that downward pressure on the push section draws the underside of the flip section across the pivot wall to cause the pivot section to pivot from a closed position to an open position;

the floor of the first portion having a dispensing hole for dispensing product, the dispensing hole covering at least 20% of the area of the main body; and an underside of the flip section of the door having a sealing ring projecting downwardly, the sealing ring having a smooth unbarbed outer periphery and sized to correspond with and frictionally engage the dispensing hole when the flip section is in the closed position to provide a seal.

28. The lid of claim 27, wherein the dispensing hole covers at least 30% of the area of the main body.

29. The lid of claim 27, wherein the dispensing hole covers at least 40% of the area of the main body.

30. The lid of claim 27, wherein the inner periphery of the dispensing hole includes a deflectable seal flange positioned to engage the sealing ring and form part of the seal.

31. The lid of claim 27, wherein the dispensing hole covers at least 1.25 square inches.

32. The lid of claim 27, wherein the dispensing hole covers at least 2.0 square inches.

33. The lid of claim 1, wherein the main body includes a recess, the door sized to be reserved within the recess.

34. The lid of claim 27, wherein the main body includes a recess, the door sized to be reserved within the recess.

* * * * *

UNITED STATES PATENT AND TRADEMARK OFFICE

CERTIFICATE OF CORRECTION

PATENT NO. : 6,742,666 B1
DATED : June 1, 2004
INVENTOR(S) : David K. Bried et al.

It is certified that error appears in the above-identified patent and that said Letters Patent is hereby corrected as shown below:

Title page,
Item [57], ABSTRACT,
Line 10, change "while gasping an item" to -- while grasping an item --.

Column 10,
Line 64, change "downward on the" to -- downward pressure on the --.

Signed and Sealed this

Twenty-seventh Day of July, 2004

JON W. DUDAS
*Acting Director of the United States Patent and Trademark Office*